US005628612A

United States Patent [19]

Bates et al.

[11] Patent Number: 5,628,612

[45] Date of Patent: May 13, 1997

[54] STACKING MACHINE WITH QUICK RELEASE MOUNTS

[75] Inventors: Jerry L. Bates, Redlands; Everardo Garza, Highland, both of Calif.

[73] Assignee: Baldwin Technology Corporation, Rosemont, Ill.

[21] Appl. No.: 323,144

[22] Filed: Oct. 14, 1994

Related U.S. Application Data

[62] Division of Ser. No. 9,774, Jan. 27, 1993, Pat. No. 5,380, 148.

[51] Int. Cl.[6] ..... B65H 29/14

[52] U.S. Cl. ..... 414/786

[58] Field of Search ..... 198/835; 271/177, 271/307; 403/87, 110, 312, 373, DIG. 9; 414/798.2; 29/895.22

[56] References Cited

U.S. PATENT DOCUMENTS

| | | | |
|---|---|---|---|
| 725,088 | 4/1903 | Johnston | 198/835 X |
| 2,933,314 | 4/1960 | Stobb | 271/88 |
| 2,998,731 | 9/1961 | Renner | 74/230.8 |
| 3,074,288 | 1/1963 | Newton | 198/835 X |
| 3,122,945 | 3/1964 | Chung | 74/802 |
| 3,501,139 | 3/1970 | Stobb | 271/68 |
| 3,664,488 | 5/1972 | Florian et al. | 198/139 |
| 3,743,078 | 7/1973 | Pittoreau | 198/121 |
| 4,146,126 | 3/1979 | Mattos | 198/862 |
| 4,221,373 | 9/1980 | Hans | 270/86 |
| 4,313,600 | 2/1982 | Mosberger | 271/203 |
| 4,361,318 | 11/1982 | Stobb | 271/202 |
| 4,463,940 | 8/1984 | Mock | 270/54 |
| 4,500,245 | 2/1985 | Madewell et al. | 271/177 X |
| 4,513,859 | 4/1985 | Long et al. | 198/842 |
| 4,723,883 | 2/1988 | Smith | 414/907 |
| 4,887,708 | 12/1989 | Brown et al. | 198/835 X |
| 4,984,677 | 1/1991 | Prakken | 198/418.6 |
| 5,004,223 | 4/1991 | Okui | 271/275 |
| 5,022,813 | 6/1991 | Smith | 414/790 |
| 5,133,543 | 7/1992 | Eitel et al. | 271/276 |

*Primary Examiner*—David A. Bucci
*Assistant Examiner*—Janice L. Krizek
*Attorney, Agent, or Firm*—Richard S. Roberts

[57] ABSTRACT

An improved stacker apparatus for the formation of aligned stacks of signatures from one or more incoming streams of partially overlapping signatures in shingled form. The stacker has an outer framework having an input end and an output end. A stream of partially overlapping signatures in shingled form is accepted at the input end and is passed to a compression conveyor. The compression conveyor has two conveyor belts in compressed opposition to one other which follow an upward arcuate path along a series of idler rollers. The series of idler rollers is mounted to the outer framework by a quick release inner framework. The conveyor transfers the signatures to a receiving station which guides successive signatures into aligned stacking registry with one another. When a conveyor belt breaks, the inner frame is quick released from the outer frame, a new belt is wound around the inner frame, and the inner frame re-mounted. Drive shaft pulley assemblies are rotably mounting to the outer framework by a quickly releasable bearing such as a two bolt flanged bearing with a screw clamp collar. This arrangement avoids removing each roller to replace a broken belt.

9 Claims, 5 Drawing Sheets

STACKING MACHINE WITH QUICK RELEASE MOUNTS

This is a divisional of application Ser. No. 08/009,774 filed on Jan. 27, 1993 now U.S. Pat. No. 5,380,148.

BACKGROUND OF THE INVENTION

The present invention relates to an apparatus for stacking a stream of printed materials in signature form. Stackers are commonly employed in the printing industry for collecting and aligning sheets of paper such as those produced by a printing press, cutter and folder arrangement. In the conventional arrangement, a stream of sheets, for example in the form of newspapers, is collected on a conveyor which receives the sheets from the printing press, cutter or folder and which moves the sheets to the stacker. The stacker receives the sheets in serial form from the conveyor and forms a neat aligned stack which is easy to tie together for removal and transportation.

Many stacking arrangements are known in the art. U.S. Pat. No. 2,933,314 describes one apparatus for stacking flexible sheets by collecting them down an inclined conveyor. This arrangement is complex and very expensive. U.S. Pat. No. 4,361,318 provides an improvement system wherein a stream of horizontal signatures is provided to a first stacker conveyor. This first conveyor compresses the signatures between opposing belts and moves the stream around a drum to change its direction vertically. The stream is then deposited on a second conveyor which moves horizontally. This provides a horizontally growing, aligned stack of sheets which is relatively easy to handle as desired. A key problem with this machine is that the drum can only be of limited size for practical use within a stacking machine. Typically, such drums are approximately one foot in diameter. This means that the incoming signatures must be bent around a relatively small drum radius of approximately six inches. This bending of signatures around a small drum radius tends to break the backbone of thicker signatures such as those in the form of books. This is particularly true since overlapping books in shingled stream form travel in plies two or three times the thickness of a single book. This prior art device also causes skewing of shingled signatures, due to the single drum acting with an outer belt to transfer the signatures from a first direction and position to a stacking receiver for bundling. These devices have also required continual adjustment of the outer belt, resulting in frequent damage to and jamming of signatures and the need to remove jammed signatures. The removal of skewed and jammed signatures requires a production stoppage and added production costs. This drum is also a problem with the machine described in U.S. Pat. No. 2,933,314.

In an attempt to overcome this drum disadvantage, U.S. Pat. No. 4,463,940, which is incorporated herein by reference, uses an upswept arcuate array of rollers in place of a single drum. This provides a greatly increased effective travel radius which treats the signatures much more gently. This latter stacking apparatus has a reduced tendency to skew and jam signatures by sequentially engaging signatures with crusher rollers and opposed endless timing belts which are compression mounted by the series of rollers. The series of rollers, as distinct from a single drum roller, distributes the applied compression more evenly along the overlapped signatures, providing constant compression. There is also greater control over the rapidly moving, highly compressed signatures, resulting in a more economical stacking since fewer signatures are lost through jamming and the conveyor belts can move at substantially constant speed.

However, even this latter stacking apparatus has disadvantageous. Since the endless timing belts which follow the path of the rollers are driven under tension, they have a tendency to break. It has always been a problem to replace broken endless timing belts since all of the rollers must be removed in an operation lasting several hours. Not only is such an operation labor intensive, but the stacker is out of production for this entire time. In state of the art stackers, each of the ends of the compression rollers are mounted for rotation through bearing bores in the machine's frame. Therefore, both ends of each roller must be disengaged and pulled through and away from the frame in order to install a new endless timing belt around every roller end. This includes both drive shaft pulley assemblies and idler rollers. The present invention improves on this arrangement by providing quick release mountings for the rollers and drive shaft pulley assemblies. By this means, broken belts can be quickly replaced, thus reducing labor costs and equipment down time. By the present invention, the shafts of drive shaft pulley assemblies, that is pulley assemblies which are spun by the machine's motor via drive belts and sprockets, are mounted by a two bolt flanged bearing with a screw clamp collar. These allow shafts to be quickly released and moved to provide a small space between the shaft and stacker frame which is sufficient to allow belt replacement through this space. The idler rollers in the upswept arcuate array of rollers which replaced the single drum, are mounted in a frame within a frame construction. The rollers are gang mounted for rotation within an inner frame. The inner frame is then fixed to the main frame of the machine by a quick release mounting. Therefore, when a timing belt breaks, an operator need not loosen the individual arcuate rollers at all. Rather, the inner frame is freed from the outer frame and the belt is wound around the inner frame into position on the rollers. Then the inner frame is re-set. Not only is labor and machine downtime reduced, but also, the life of the rollers is extended since frequent roller unmounting and mounting erodes the roller shaft ends. Various mountings for conveyor rollers are shown in U.S. Pat. Nos. 5,004,223; 4,984,677; 4,513,859; 4,146,126; 3,743,078; 3,664,488; 3,122,945 and 2,998,731.

These and other features and advantages and improvements will be in part discussed and in part apparent to one skilled in the art upon a consideration of the detailed description of the preferred embodiment and the accompanying drawings.

SUMMARY OF THE INVENTION

Figure 1:
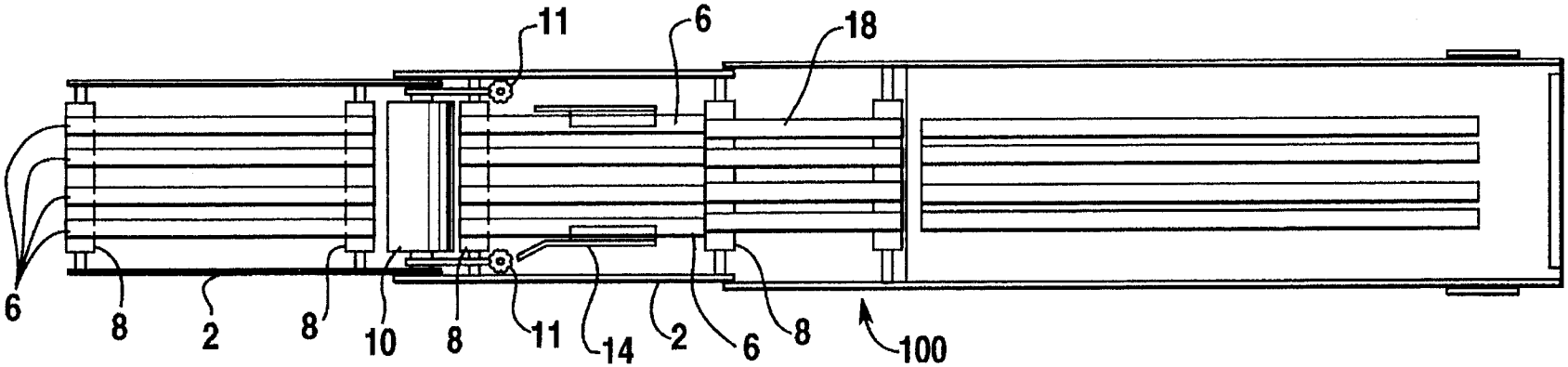
FIG. 1 shows a top overview in schematic form of the layout of a conveyor, crusher, jogger, stacker, and bundling table.

The invention provides a stacker apparatus for the formation of aligned stacks of signatures from one or more incoming streams of partially overlapping signatures in shingled form. The apparatus comprises an outer framework having an input end and an output end. Means are provided for accepting at least one stream of partially overlapping signatures in shingled form at the input end and passing the signatures to compression conveyor means. The compression conveyor means are adjacent to and in line with the input end of the outer framework. The compression conveyor means comprises first and second floating conveyor belt means in compressed opposition to one other. The compression conveyor means follow an upward arcuate path from the input end to the output end defined by a plurality of idler rollers mounted in juxtaposition to one of the conveyor belt means. The idler rollers are mounted to the outer framework by quick release mounting means. The compression conveyor means is capable of transferring the partially overlapping signatures in shingled form from the input end to the output end between the first and second conveyor belt means. A receiving station is located adjacent to and in line with the compression conveyor at the output end of the framework. The receiving station guides successive signatures into aligned stacking registry with one another. Means are provided for driving the conveyor belt means along the arcuate path.

The invention also provides a method for replacing a broken conveyor belt with an intact conveyor belt means in a stacker apparatus. The method comprises mounting the idler rollers to the outer framework by quick release mounting means; releasing the idler rollers from the outer framework via the quick release mounting means to form a space between the rollers and the outer framework. The method provides removing the broken conveyor belt means; winding intact conveyor belt means through the space and positioning it with the idler rollers; and then re-mounting the rollers to the outer framework with the quick release mounting means. In the preferred embodiment, the method comprises rotatably mounting each of the idler rollers to an inner framework and attaching the inner framework to said outer framework by quick release mounting means.

In another embodiment of the invention, drive shaft pulley assemblies are rotatably mounted to the outer framework and engage the conveyor belt means. The shaft has means for quickly forming a space associated with it sufficient to allow the passage of conveyor belt means through the space. The latter means can be a quickly releasable bearing mounting the shaft on the outer framework or a quick release connector between the ends of and spanning the shaft. The preferred embodiment uses a quickly releasable bearing which is a two bolt flanged bearing with a screw clamp collar. The invention also contemplates a method for retrofitting existing state of the art stackers by mounting idler rollers to an inner framework and attaching the inner framework to the outer framework by quick release mounting means and providing a quick release arrangement of drive shaft pulley assemblies as above.

Yet another embodiment of the invention provides a method for replacing a broken endless conveyor belt with an intact endless conveyor belt in a conveyor apparatus having a plurality of rollers mounted for rotation therein. The method comprises mounting the rollers for rotation within an inner framework, mounting the inner framework to an outer framework by quick release mounting means; releasing the inner framework from the outer framework via the quick release mounting means to form a space between the inner framework and the outer framework; removing the broken conveyor belt; winding intact endless conveyor belt through the space and juxtapositioning it with the rollers; and re-mounting the inner framework to the outer framework with the quick release mounting means.

DETAILED DESCRIPTION OF THE PREFERRED EMBODIMENT

Figure 2:
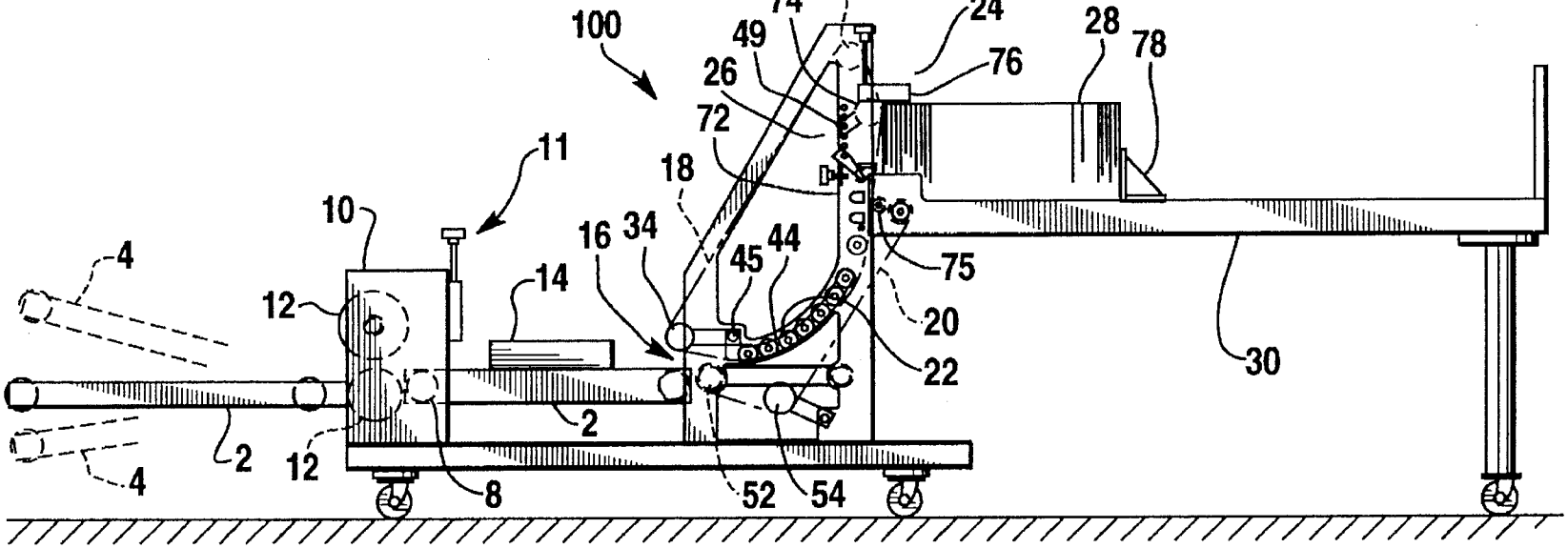
FIG. 2 shows a side overview in schematic form of the layout of a conveyor, crusher, jogger, stacker, and bundling table.

Referring to FIGS. 1 and 2, one respectively sees a top and side view of a stacker 100 according to the present invention together with attendant conveyors. A continuous stream of signatures flows along conveyor 2 from the end of a printing press, folding machine or cutting machine which are not shown. Single or multiple streams of signatures may be accommodated. FIG. 2 shows in phantom outline such additional signature streams 4. Conveyor 2 is of conventional construction and includes supported conveyor belts 6 and rollers 8 as best seen in FIG. 1. For multiple streams, stackers may be superimposed above one another. Horizontal conveyor 2 is preferably composed of several separate endless belts 6, spaced laterally a few inches apart. These belts move at the same speed and convey the signatures in a shingled stream partially overlapping form. Preferably disposed in-line with conveyor 2 is a crusher station 10. Crusher station 10 comprises two opposed crusher rollers 12. The upper roller is vertically adjustable by means 11 relative to its lower counterpart roller. The crusher presses on the approaching shingled signatures to exhaust air and flatten them for their transition from horizontal to vertical travel. Optionally, the crushed signatures may then pass through a jogging station 14 to align the signatures edgewise and move them forward. In operation, folded, overlapped signatures exiting from the end of the press are stream transferred horizontally on conveyor 2, crushed at crusher station 10, to exhaust air and compact them, and jogged at jogger station 14 to align them prior to entry into stacker 100.

Stacker 100 has an input end 16, sets of opposing, floating compressive conveyor endless timing belts 18 and 20, an upwardly arcing set of rollers 22 and a receiver station 24 at output end 26. Upon introduction into the input end 16, the signatures enter a compression zone at the nip of the two conveyors 18 and 20. The endless timing belts travel a continuous path, part of which is adjacent to the upwardly sloped roller arc 22. The arc path is approximately ninety degrees. The stream of shingled signatures is then passed between conveyor belts 18 and 20 which maintain the signatures fully compressed during their transition from a horizontal to a vertical position. The conveyor 20, while not directly contiguous to rollers 22 indirectly applies compression against the conveyor 18 and the rollers 22 via the signatures which are conveyed between floating conveyors 18 and 20. This system creates a suitable compression zone for the safe passage of the overlapped signatures through transition from horizontal to vertical prior to actual stacking. After leaving the compression zone, the stream of signatures is provided with an upward thrust along arcuate set of rollers 22 and is kicked, stopped, and jogged into a vertical stacking mode at receiver station 26. As the signatures continue into and out of the stacker conveyors they are received and stacked vertically as shown at 28. The stacks may then be moved by conveying means 30 for palletizing or bundling of the product for shipment.

Figure 3:
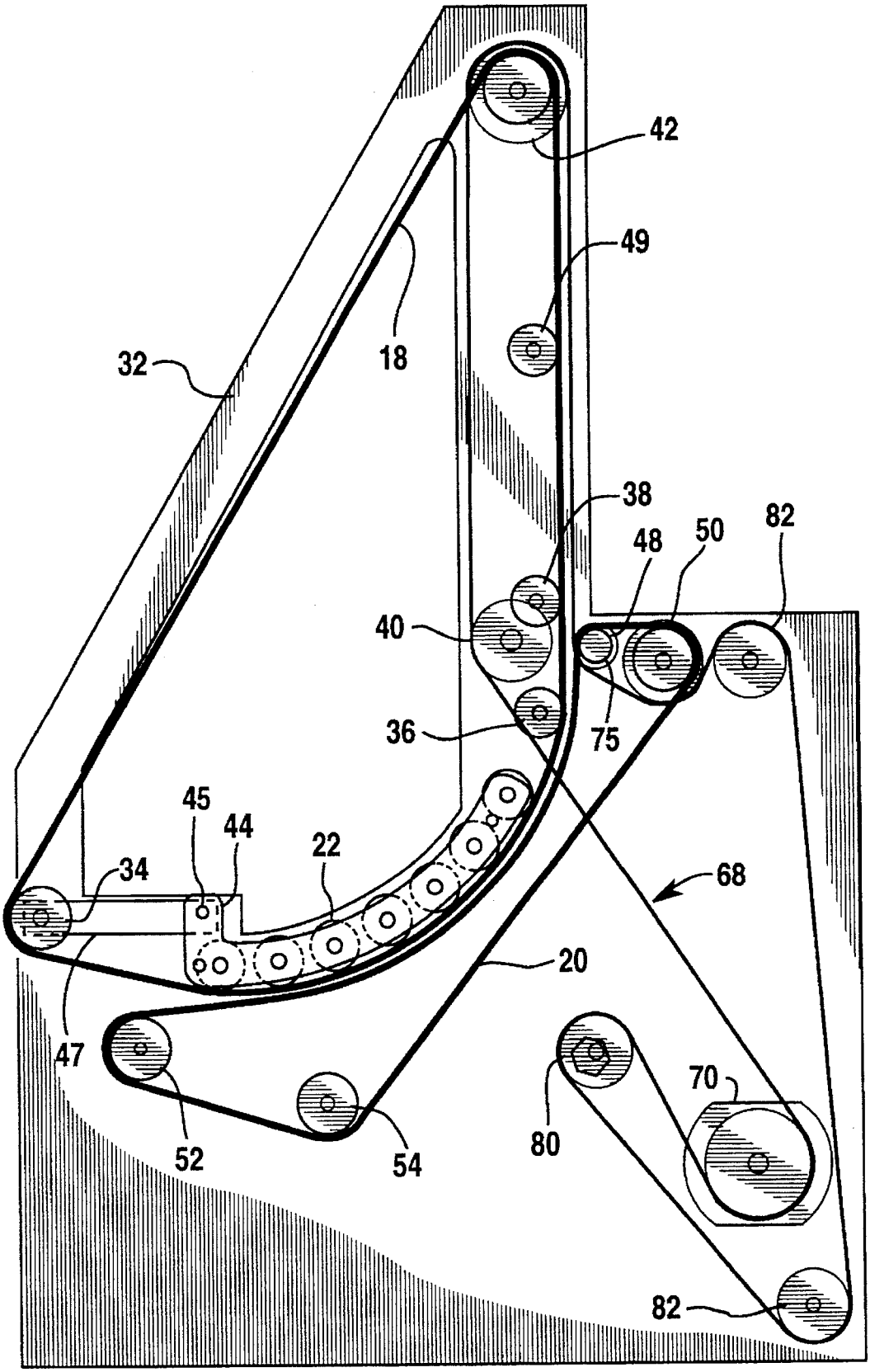
FIG. 3 shows a partial cross-sectional view of the right side of the stacker of the present invention.
Figure 4:
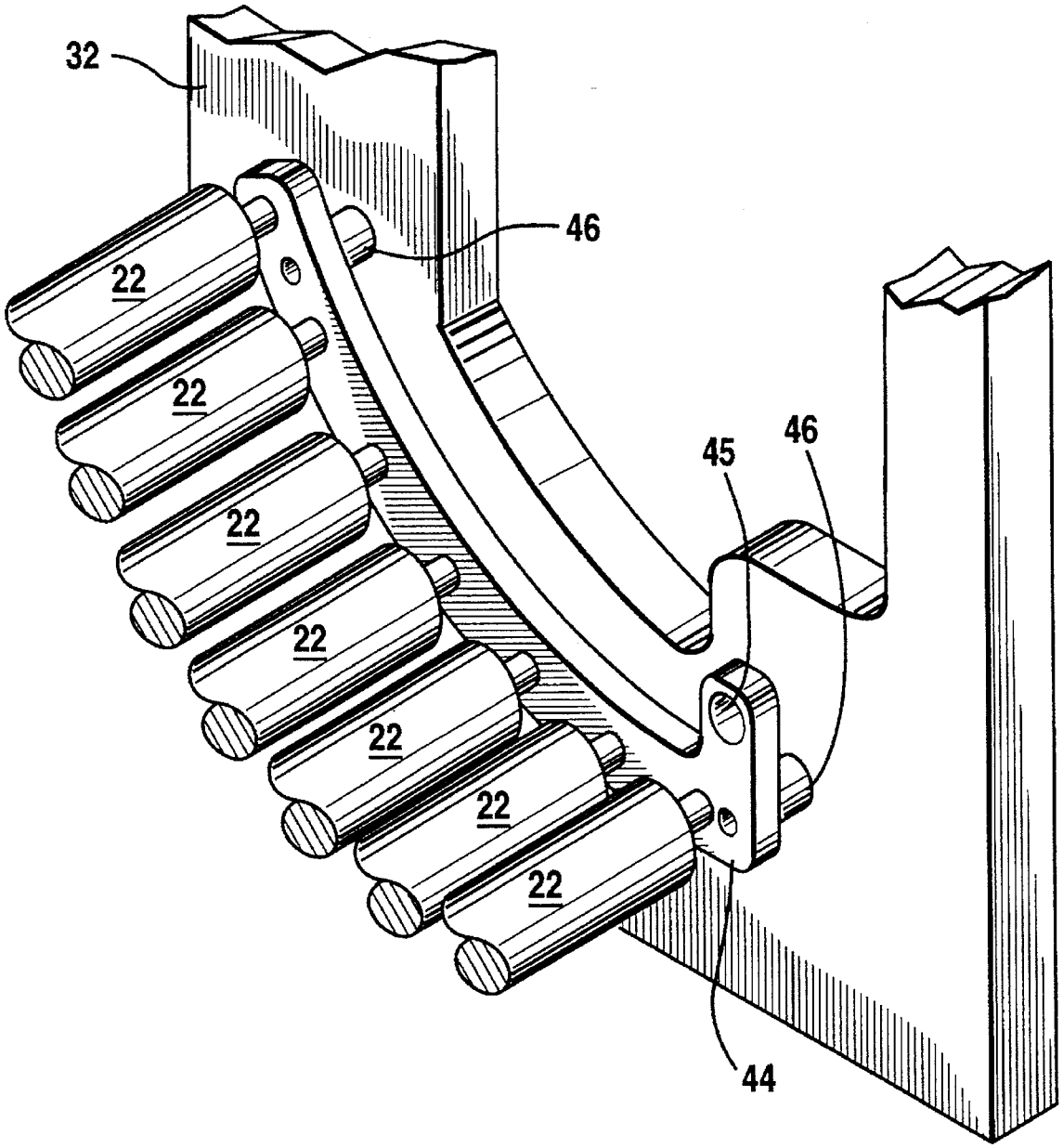
FIG. 4 shows an inside view of an inner framework with several attached rollers.
Figure 7:
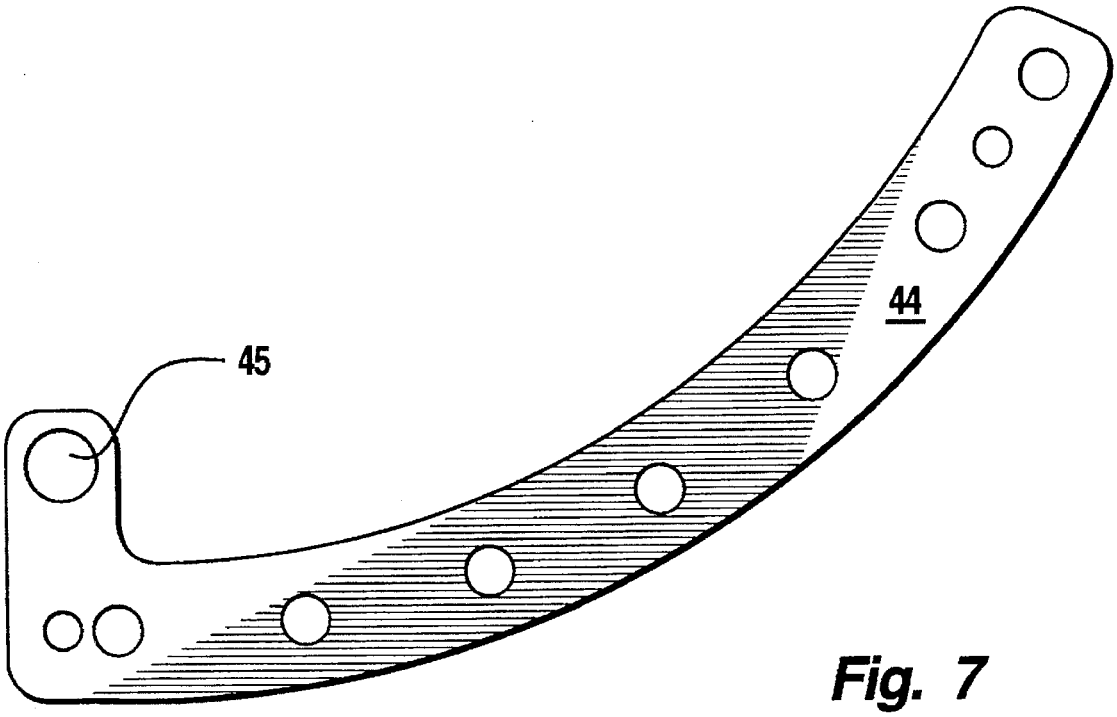
FIG. 7 shows a side view of an upswept inner framework used to connect an arcuate array of idler rollers.

FIG. 3 shows a partial cross-sectional view of stacker 100. It is shown to comprise an outer framework 32 which supports and connects the other operating parts of the device. An upper conveyor system comprises upper conveyor belts 18, pullies 34, upswept arcuate idler rollers 22, adjustable idler rollers 36 and 38, adjustment pullies on a fixed shaft 49 and drive shaft pulley assembly 42. In the preferred embodiment, on the far side of the stacker, each of the rollers 22 are rotably mounted within outer framework 32. However, on the near side of the stacker, each of the rollers 22 is rotably mounted within an inner framework 44. This is best seen in FIG. 4. The inner framework 44 is attached to the outer framework 32 by quick release mounting means. This may include a pair of bolts which first pass through outer framework 32, then through spacers 46 and then inner framework 44. FIG. 7 shows a side view of inner framework 44. When one of the belts 18 breaks, the quick release mounting means such as bolts and spacers 46 are removed, forming a narrow space between outer framework 32 and the inner framework 44 in the position vacated by spacers 46. A replacement belt can then be wound around the inner framework 44 and positioned on the rollers 22. Hole 45 is provided for the mounting of a bracket 47 which allows the pivoting of pullies 34 on their shaft. The lower conveyor system comprises conveyor belts 20, drive shaft pulley assemblies 48 and 50 as well as pullies 52 and 54. Both upper and lower conveyor systems 18 and 20 preferably comprise five endless timing belts, laterally spaced a few inches apart from one another. They may be tensioned by means of pulleys as desired. Each conveyor roller measures approximately 2 inches in diameter.

Figure 5:
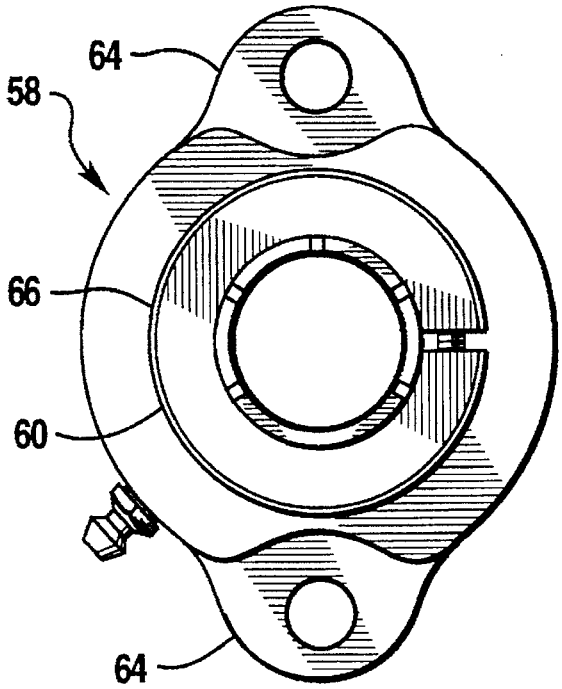
FIG. 5 shows a front view of a two bolt flanged bearing with a screw clamp collar which is used as part of the invention to attach a drive shaft pulley assembly.
Figure 6:
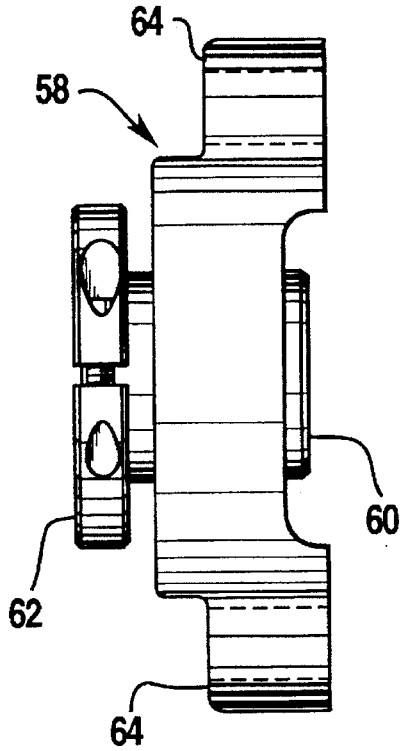
FIG. 6 shows a side view of a two bolt flanged bearing with a screw clamp collar which is used as part of the invention to attach a drive shaft pulley assembly.
Figure 8:
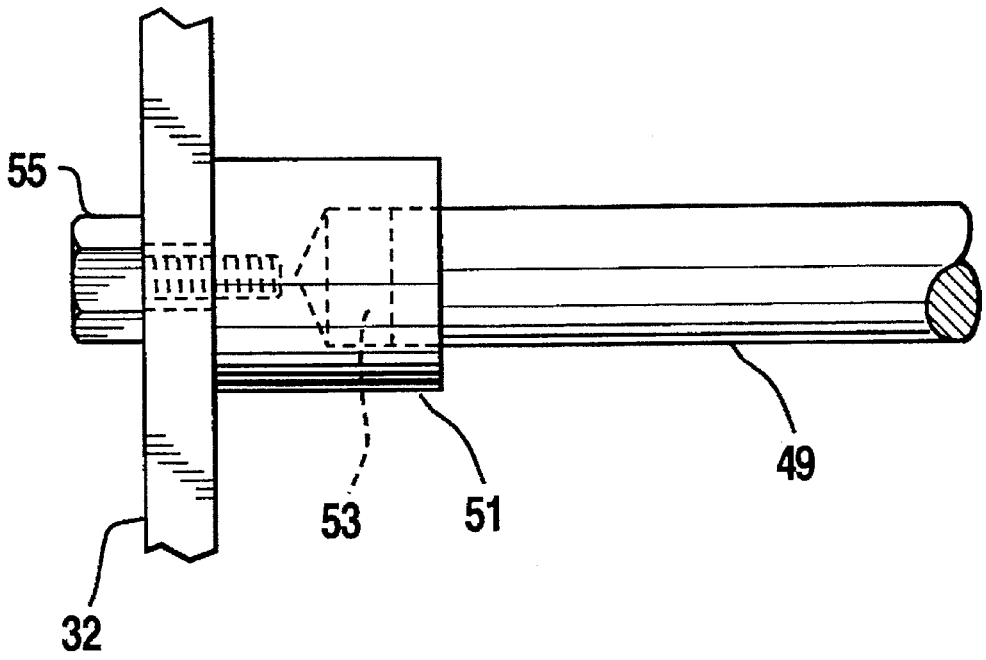
FIG. 8 shows another embodiment of quick release means to mount a drive shaft to the framework.
Figure 9:
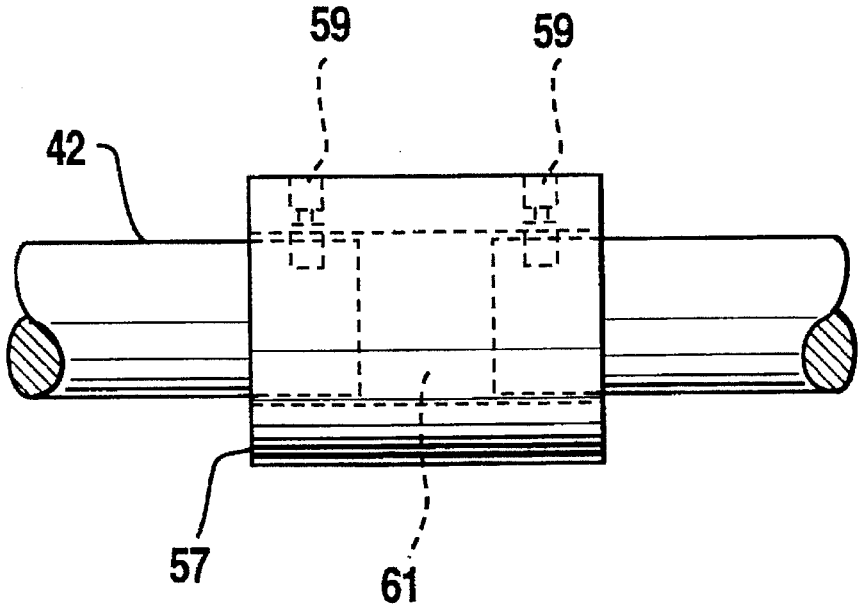
FIG. 9 shows another embodiment of the invention employing a split drive shaft.

While the above mentioned arrangement is most satisfactory for allowing replacement belts to be inserted around the idler rollers 22, the replacement belts must also be wound around drive shaft pulley assemblies. In current state of the art stackers, drive shaft pulley assemblies must also be removed in order to insert a replacement belt. This removal has all of the disadvantages described above. In the present invention, at least one end of each drive shaft pulley assembly is mounted to the outer framework by a quick release bearing such as a two bolt flanged bearing with a screw clamp collar 58 as shown in FIGS. 5 and 6. The inner shaft of each drive shaft pulley assembly is passed through inner bore 60 and clenched by screw clamp portion 62. The bearing may be attached to the outer framework by means of screws through upper and lower flanges 64. In use, inner bore 60, when fixed to the drive shaft pulley assembly end, revolves within bearing race 66. Therefore the inner bore and screw clamp portion 62 revolve with the bearing. The drive shaft only extends through the screw clamp portion 62 but not through the bore 60. When a belt needs to be replaced, the screw clamp 62 is loosened from around the shaft, the screws through the upper and lower flanges are removed and the bearing is allowed to slide along the shaft toward the center of the machine. The drive shaft pulley assembly is thereby effectively disengaged from the outer framework to form a space between the shaft and the outer framework. The belt is wound through this created space, and the bearing is re-assembled and clamped to the roller shaft. Since the endless timing belts are approximately one-quarter inch thick, the space is sufficient to allow the belt to pass through. There is no need to completely remove the drive shaft pulley assemblies as is currently required in the art. In addition, to replace a timing belt in prior art machines, the drive chain must be removed from its sprockets. By the method of this invention, the drive chain need not be removed. In another embodiment of the invention, each drive shaft pulley assembly can be mounted for rotation on the outer framework by suitable mounting means. FIG. 9 shows a drive shaft such as 42 which can comprise a quickly releasable connector 57 which spans a space between split shaft ends. This connector 57 may be a clamping collar, for example, a long clamping collar which is key mounted to each shaft portion via a keyway 59. This facilitates rotary motion of the shaft. By keying and releasing the connector, a space 61 is disclosed between the ends of the shaft. The broken conveyor belt is removed and a new belt is wound through the space 61 to replace the broken belt. The connector is then keyed connected together again to re-form the drive shaft pulley assembly for use. In this embodiment, the ends of the shaft may be mounted for rotation to the outer framework by any suitable means. In another embodiment of the invention, FIG. 8 shows a quick release collar for a stationary shaft such as shafts 49 and 52. Shaft 49 is attached to outer framework 32 by a collar 51. The shaft extends part of the way through collar 51 through drilled space 53. Collar 51 is attached to framework 32 by means of a bolt 55 which extends through a clearance hole in the framework. In order to replace a belt, bolt 55 is removed and freed collar 51 is moved to the right by pushing the end of shaft 49 through space 53. The belt is then wound through the thusly formed space between the collar and the framework. Thereafter the procedure is reversed to re-attach the collar to the framework. For the purposes of this invention, the term "quickly releasable", when it refers to mounting means, connectors or bearings includes any means by which a sufficient space may be formed for winding a conveyor belt through it, either along a shaft, or between a shaft end and the outer framework, or between the inner framework and the outer framework wherein the shaft ends or idler roller ends need not be pulled through a bore in the framework or away from direct contact connection to the framework for release.

As will be apparent, the multiple belts comprising conveyors 18 and 20 are driven at the same relative speed by drive sprockets which are directly rotated by the propelling of chain 68. The appropriate sprockets are disposed at the ends of the drive shaft pulley assemblies. The rollers may be spring loaded to effect the compressive floating function upon the respective conveyors 18 and 20. This is important to effect a successful transition in the co-active compression upon the shingled signatures through the conveyors 18 and 20. All the rollers and compression conveyors 18 and 20 are rotated at the same relative speed by interconnection with drive motor 70. Each belt of the conveyor belts 18 and 20 moves at a constant relative speed, the speed control of which is maintained through engagement of drive chain 68 with the sprockets of the drive shaft pulley assemblies. In the preferred embodiment as shown in FIG. 3, the drive chain 68 follows a path which includes motor 70, eccentric chain tensioner 80, routing idler sprockets 40 and 82, and drive shaft pulley assemblies 42, 48 and 50.

After leaving the compression zone between the upper and lower conveyors, the signatures have now essentially completed the transition from a horizontal position to a vertical position. Kicker wheel 75 thrusts each signature forward to provide room for the next signature to enter. These are well known in the art. At this juncture, the signatures are individually engaged by two spaced apart wheels at points 72 and 74 which adjust for product thickness as shown in FIG. 2. Each signature is kicked upwardly and strikes adjustable receiver stripper fingers 76 and is displaced sideways from the stripper fingers 76 by a following signature. The signature is subsequently engaged by delivery table conveyor 30 while in a vertically aligned upstanding position. The growth of each stack is checked by a slidable backstop 78, which is placed to engage the stacked product as it moves along the conveyor 30. Various controls are preferably incorporated in the stacker apparatus to achieve a self-contained portable unit. In addition, the entire unit may be mounted on caster wheels so that it may be moved into and out of cooperation with an upstream folder, cutter and/or press. As will be apparent the conveyor 18 and 20 are respectively tensioned by spring loaded and gravity weight as required.

While the invention has been shown and described with reference to a preferred embodiment, it is not to be considered limited thereby, but only construed in accordance with the following claims.

What is claimed is:

1. A method for replacing broken conveyor belt means with intact conveyor belt means in a stacker apparatus used for the formation of aligned stacks of signatures from one or more incoming streams of partially overlapping signatures in shingled form, said stacker apparatus having a.) an outer framework having an input end and an output end; and b.) means for accepting at least one stream of partially overlapping signatures in shingled form at the input end and passing said signatures to compression conveyor means; and c.) said compression conveyor means being adjacent to and in line with the input end of the outer framework; said compression conveyor means having first and second floating conveyor belt means in compressing opposition to one another; said compression conveyor means following an upward arcuate path from the input end to the output end defined by a plurality of idler rollers mounted in juxtaposition to one of said conveyor belt means; said compression conveyor means being capable of transferring said partially overlapping signatures in shingled form from said input end to said output end between said first and said second conveyor belt means; and d.) a receiving station located adjacent to and in line with the compression conveyor means at the output end of the outer framework, said receiving station guiding successive signatures into aligned stacking registry with one another; and e.) means for driving the compression conveyor means along said path, the method comprising mounting said idler rollers to said outer framework by quick release mounting means; releasing said idler rollers from said outer framework via said quick release mounting means to form a space between said rollers and said outer framework; removing broken conveyor belt means; winding intact conveyor belt means through said space and juxtapositioning said intact conveyor belt means with said idler rollers; and re-mounting said rollers to said outer framework with said quick release mounting means.

2. The method of claim 1 wherein the means for driving the compression conveyor means comprises at least one drive shaft pulley assembly mounted on said outer framework which engages said compression conveyor means, the method further comprising either a or b:

a.) mounting said at least one drive shaft pulley assembly to said outer framework by a quickly releasable bearing; releasing said drive shaft pulley assembly from said outer framework via said bearing to form a space between said drive shaft pulley assembly and said outer framework; removing broken conveyor belt means; winding an intact compression conveyor means through said space and juxtapositioning said intact conveyor belt means with said drive shaft pulley assembly; and re-mounting said drive shaft pulley assembly to said outer framework with said quickly releasable bearing; and b.) mounting said at least one drive shaft pulley assembly to said outer framework and wherein said drive shaft pulley assembly comprises quickly releasable connector means intermediate to ends of and spanning said drive shaft pulley assembly; releasing said connector means thereby forming a space between the ends of the drive shaft pulley assembly; removing broken conveyor belt means; winding an intact compression conveyor means through said space and juxtapositioning said intact conveyor belt means with said drive shaft pulley assembly; and reconnecting said drive shaft pulley assembly with said quickly releasable connector means.

3. The method of claim 2 wherein said quickly releasable bearing is a two bolt flanged bearing with a screw clamp collar.

4. The method of claim 1 wherein each idler roller has a central shaft extending longitudinally therethrough and a pair of ends; one of said ends being mounted for rotation on said outer framework and the other end being mounted to an inner framework, said inner framework being mounted to said outer framework by quick release mounting means.

5. The method of claim 4 wherein the means for driving the compression conveyor means comprises at least one drive shaft pulley assembly mounted on said outer framework which engages said compression conveyor means, the method further comprising either a or b:

a.) mounting said at least one drive shaft pulley assembly to said outer framework by a quickly releasable bearing; releasing said drive shaft pulley assembly from said outer framework via said bearing to form a space between said drive shaft pulley assembly and said outer framework; removing broken conveyor belt means; winding an intact conveyor belt means through said space and juxtapositioning said intact conveyor belt means with said drive shaft pulley assembly; and re-mounting said drive shaft pulley assembly to said outer framework with said quickly releasable bearing; and b.) mounting said at least one drive shaft pulley assembly to said outer framework and wherein said drive shaft pulley assembly comprises quickly releasable connector means intermediate ends of and spanning said drive shaft pulley assembly; releasing said connector means thereby forming a space between the ends of the drive shaft pulley assembly; removing said broken conveyor belt means; winding an intact conveyor belt means through said space and juxtapositioning said intact conveyor belt means with said drive shaft pulley assembly; and re-connecting said drive shaft pulley assembly with said quickly releasable connector means.

6. The method of claim 5 wherein said quickly releasable bearing is a two bolt flanged bearing with a screw clamp collar.

7. The method of claim 4 wherein said inner framework has an arcuate configuration complementary to said upward arcuate path.

8. The method of claim 1 wherein said compression conveyor means comprises at least one timing belt.

9. A method for replacing a broken endless conveyor belt with an intact endless conveyor belt in a conveyor apparatus, which apparatus has a plurality of rollers mounted for rotation therein, the method comprising mounting said rollers for rotation within an inner framework, mounting said inner framework to an outer framework by quick release mounting means; releasing said inner framework from said outer framework via said quick release mounting means to form a space between said inner framework and said outer framework; removing said broken conveyor belt; winding said intact endless conveyor belt through said space and juxtapositioning said intact endless conveyor belt with said rollers; and re-mounting said inner framework to said outer framework with said quick release mounting means.

* * * * *